US005634641A

United States Patent [19]

Roman

[11] Patent Number: 5,634,641

[45] Date of Patent: Jun. 3, 1997

[54] PLAY DEVICE TO MATCH UP DATA OR DESIGNS

[75] Inventor: Massimiliano Roman, Vedano, Italy

[73] Assignee: DSLE System S.A., Lugano, Switzerland

[21] Appl. No.: 612,868

[22] PCT Filed: Jul. 7, 1995

[86] PCT No.: PCT/CH95/00159

§ 371 Date: Mar. 13, 1996

§ 102(e) Date: Mar. 13, 1996

[87] PCT Pub. No.: WO96/02307

PCT Pub. Date: Feb. 1, 1996

[30] Foreign Application Priority Data

Jul. 15, 1994 [FR] France ..... 94 09064

[51] Int. Cl.[6] ..... A63F 9/08

[52] U.S. Cl. ..... 273/155; 273/153 R

[58] Field of Search ..... 273/153 R, 155, 273/153 S; 446/103; 434/401, 402, 404, 407

[56] References Cited

U.S. PATENT DOCUMENTS

| | | | |
|---|---|---|---|
| 4,560,164 | 12/1985 | Darling | 273/155 |
| 4,752,074 | 6/1988 | Juang | 273/155 |
| 4,784,387 | 11/1988 | Liversidge . | |
| 4,869,506 | 9/1989 | Wiggs et al. | 273/155 |
| 5,100,142 | 3/1992 | Cannata | 273/155 |
| 5,370,394 | 12/1994 | Huncaga | 273/155 |

*Primary Examiner*—Steven B. Wong
*Attorney, Agent, or Firm*—Young & Thompson

[57] ABSTRACT

An amusement device according to the invention offering numerous possibilities for mapping data with results, for example, drawings, mathematical functions, names and the like depicted on visible surfaces (6, 16, 24, 25, 34, 35) which are adjacent and rotatably or revolvingly movable. The device includes a base unit (2) with a visible surface (6), carrying several rotating elements (10, 13, 17, 19, 21, 23), two of which have visible surfaces. Angular locating means (41–46) are arranged on the surfaces for displaying the data and results and for matching pairwise. Fixed ratio kinematic connections, especially gears, transmit rotations between rotating elements and manual driving means (8, 11, 14).

21 Claims, 7 Drawing Sheets

PLAY DEVICE TO MATCH UP DATA OR DESIGNS

Figure 1:
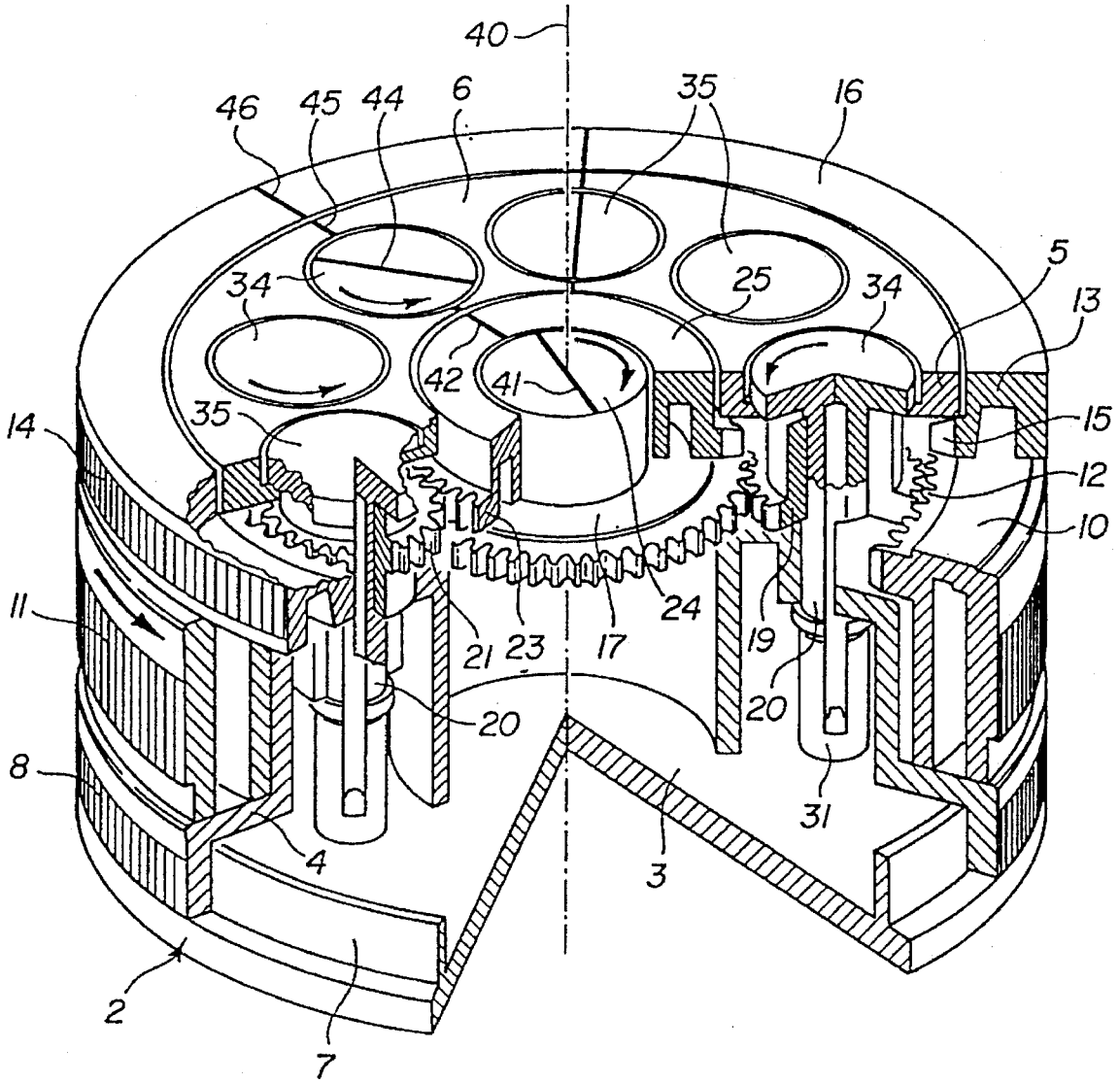

The present invention relates to a play device to match up graphical or alpha-numeric data on at least one upper surface of the device.

Such devices are known in the form of computational disks, which is to say computation scales in circular form. In this case, two logarithmic scales are disposed opposite each other on an upper surface of the device, respectively on two concentric elements of which one is rotatable relative to the other which serves as a base block. This system of course permits bringing into correspondence, for each position of the rotatable element, data or results on said scales (or on additional scales), for example two multiplication factors and the result of the latter. However, these uses of such a device are limited in practice to arithmetic operations and to mathematical functions with a single variable.

The present invention has for its object a more elaborate device, offering multiple possibilities for using data and results which can be not only continuous mathematical functions, but also discrete values, of nonnumerical data such as names, symbols, logical operators, communication ports, etc. or various graphical elements such as designs. A particular object of the invention consists in arranging the device such as to permit a large number of possible combinations between diverse data, which is to say the physical elements which they bear.

According to a basic aspect of the present invention, there is provided a device of the type indicated above, which comprises:

- a base block having a first surface visible on said upper surface;
- at least two rotatable elements arranged to turn about parallel axes on the base block and having respectively a second and a third surface visible on said upper surface;
- at least one manual drive means to turn at least one of said rotatable elements relative to the base block;
- rotation transmission means, forming kinematic connections with fixed ratios between the base block, the rotatable elements and the manual drive means;
- angular location means, arranged on said visible surfaces of the base block and on the rotatable elements and representing data and results in the form of circular scales, for indexing and/or other graphical elements, these locating means being disposed so as to be placed in mutual correspondence by rotation with the rotatable elements driven by said manual means.

Thus, the upper surface of the device has at least three visible surfaces which are movable relative to each other and which permit being placed in correspondence two-by-two by mutual rotation. This permits in particular causing to correspond the data on two of these surfaces, to find a result by correspondence between one of them and a third surface. In another application in which the fixed ratio of a kinematic connection between the two rotatable elements is not a whole number, the device can be a game consisting in finding the respective positions of the two rotatable elements which fulfil a given condition, for example which complete in a coherent manner a design distributed on said visible surfaces of the upper surface of the device.

To define fixed kinematic ratios, the transmission means can comprise gearing, chains and/or toothed belts.

In one preferred embodiment, two of said rotatable elements are coaxial. In particular, it can be provided that the first, the second and the third visible surface are adjacent two-by-two, one of them being disposed between the two others.

According to a first modification of the device, said two rotatable elements are coupled by a kinematic connection with fixed ratio, one to the other, and to common manual drive means. In another modification, permitting more complicated combinations, said two rotatable elements are coupled respectively to two manual drive means, adapted to be actuated independently of each other.

In a preferred embodiment of the device, the transmission means comprise at least one planetary gearing. Preferably, three coaxial planetary gearing elements, namely two planetary wheels and a planet carrier, belong respectively to said rotatable elements and to the base block. Planet gears can also constitute rotatable elements each having a visible surface provided with locating means.

In the case in which two drive means are provided, the transmission means can comprise two coaxial planetary gearings which have a common element and which are each connected to one of the two manual drive means. Said manual drive means can be planet wheels external to the planetary gearing and can comprise gripping means on their periphery. Said common element can be a planet carrier which is a portion of the base block. The planet carriers and two internal planet wheels of the planetary gearing can have mutually concentric visible surfaces on said upper surface.

In a particular embodiment of the device, usable preferably for games of the lottery type, the device contains a hidden recess for a token such as a ball, an outlet opening for seeing the token and movable closure members driven by the rotatable elements and arranged to close a passage for the token between said recess and said opening, each closure member comprising a hole for the passage of the token, said passage being freed by a single position of mutual coincidence of the recess, of the holes and of the opening, corresponding to a predetermined position of said visible surfaces.

Said recess can be located in one of the rotatable elements. At least one of the closure members can be comprised by one of the rotatable elements or can be a flat cam driven in translation and in pivoting movement by rotatable elements.

Said token can preferably comprise a sign which indicates a gain, particularly a predetermined color.

In a modified embodiment, the device can comprise means which coact with said token, to trigger a sonic and/or visual signal at the moment of freeing of the token.

Preferably, said means comprise a switch arranged to be actuated by said token, an energy source and an electronic circuit integrated in such a way as to emit said sonic and/or visual signal.

Figure 2:
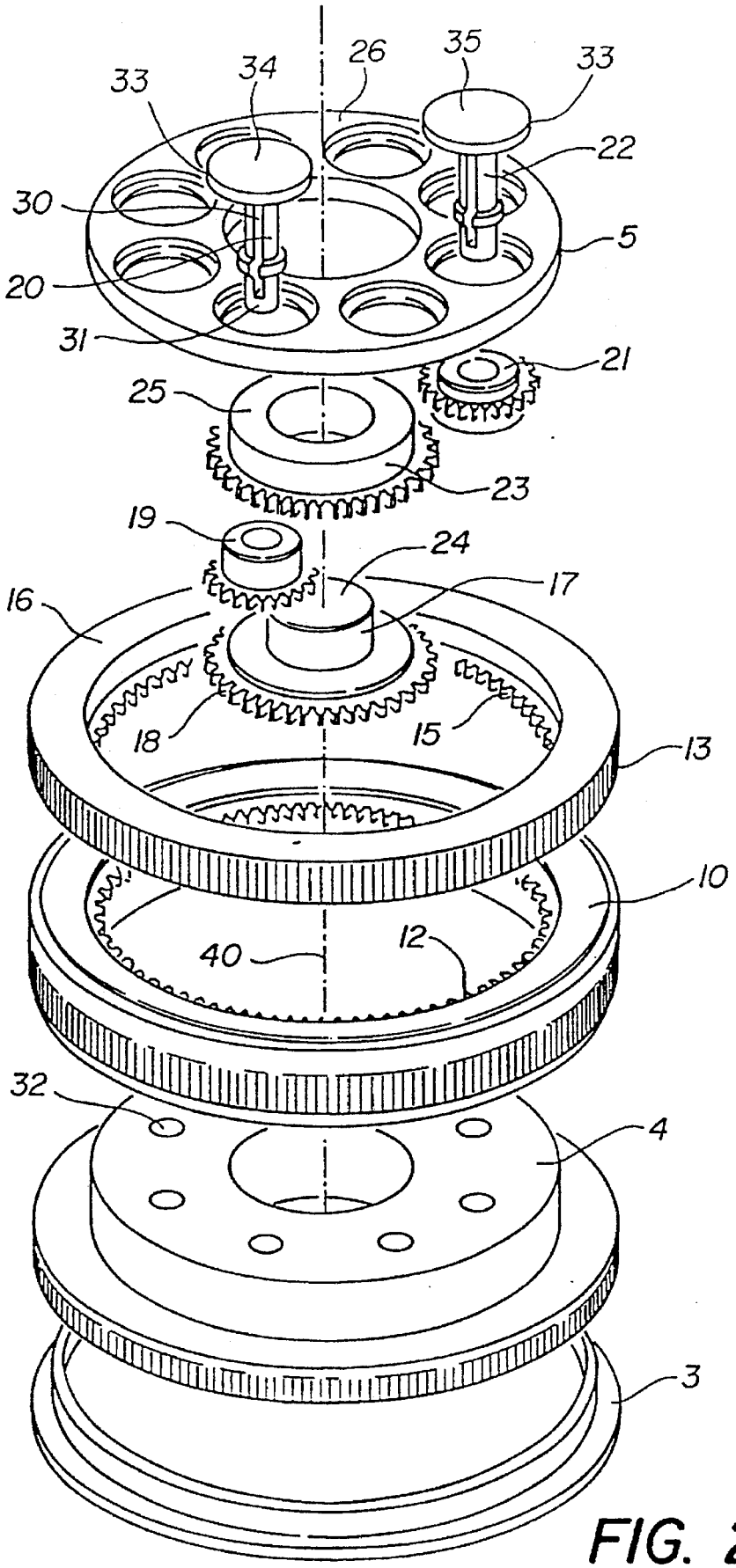
Figure 3:
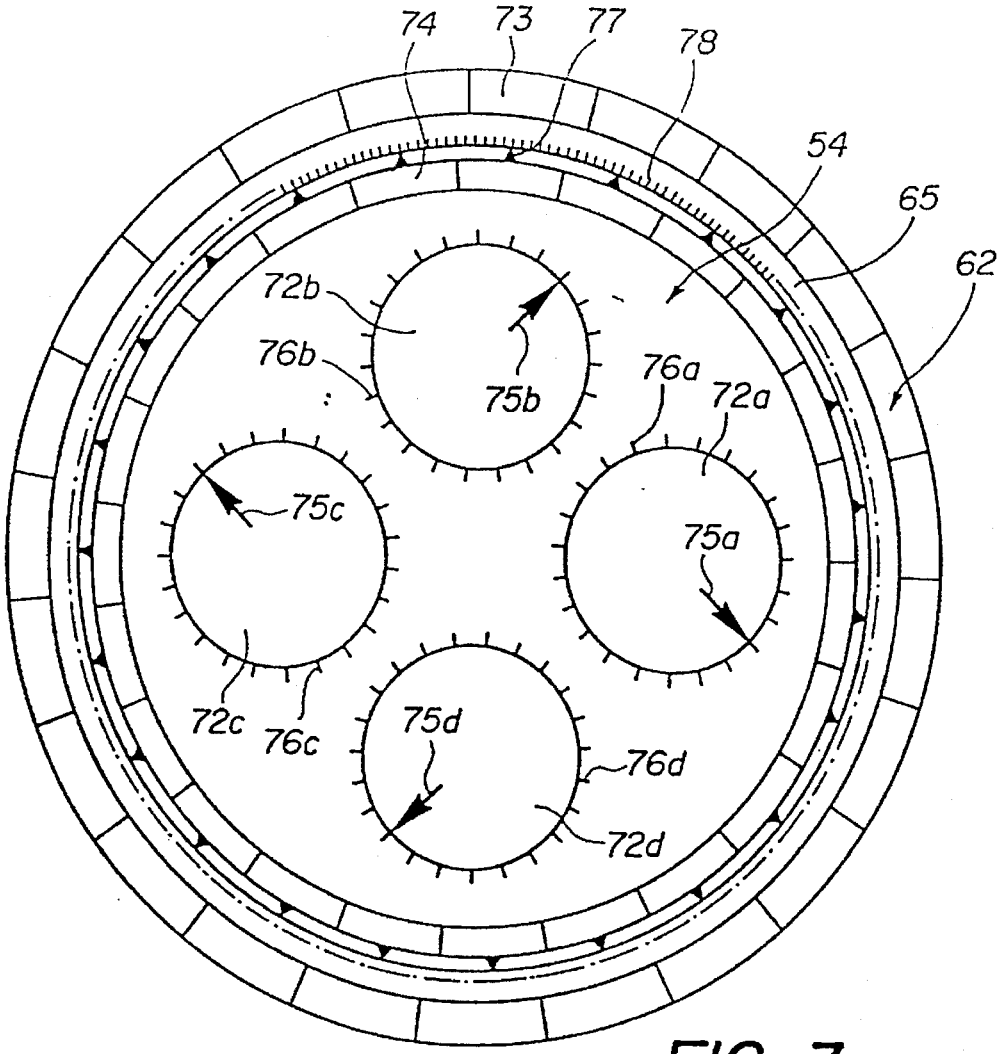
Figure 4:
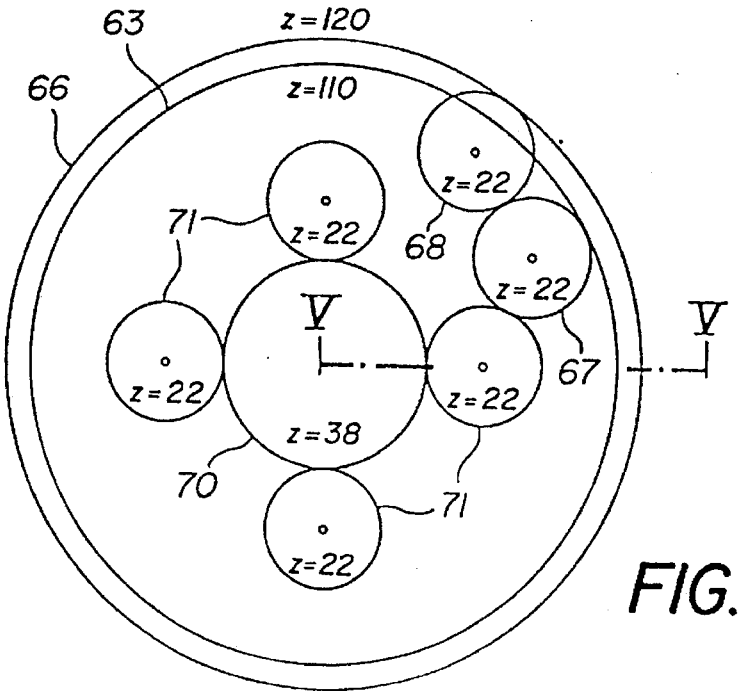
Figure 5:
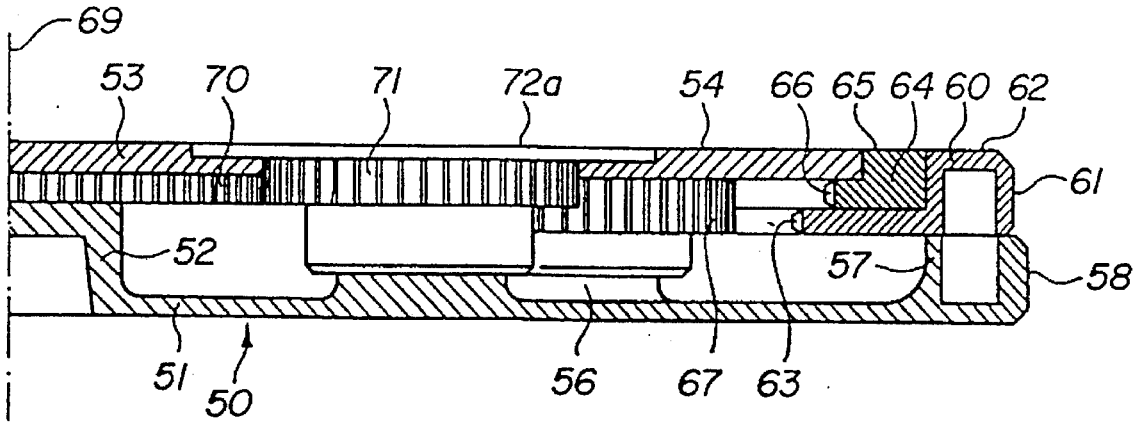
Figure 6:
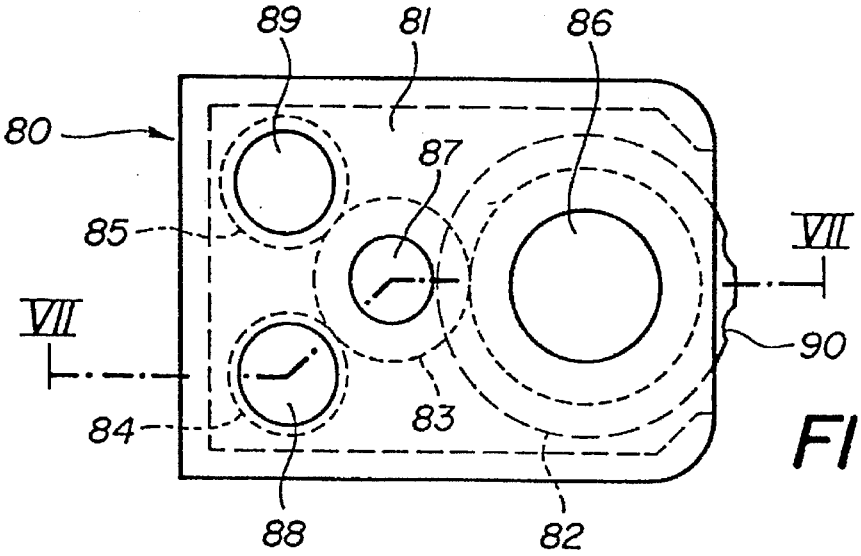
Figure 7:
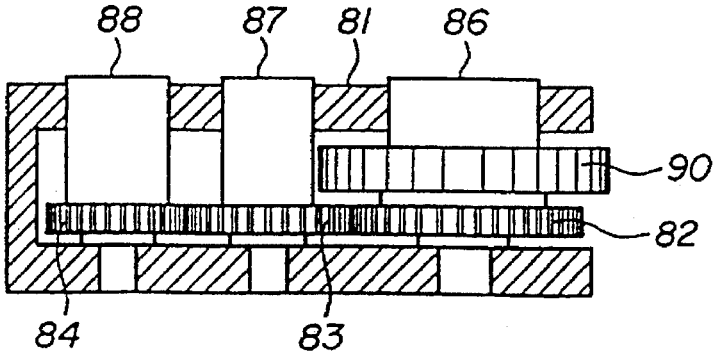
Figure 8:
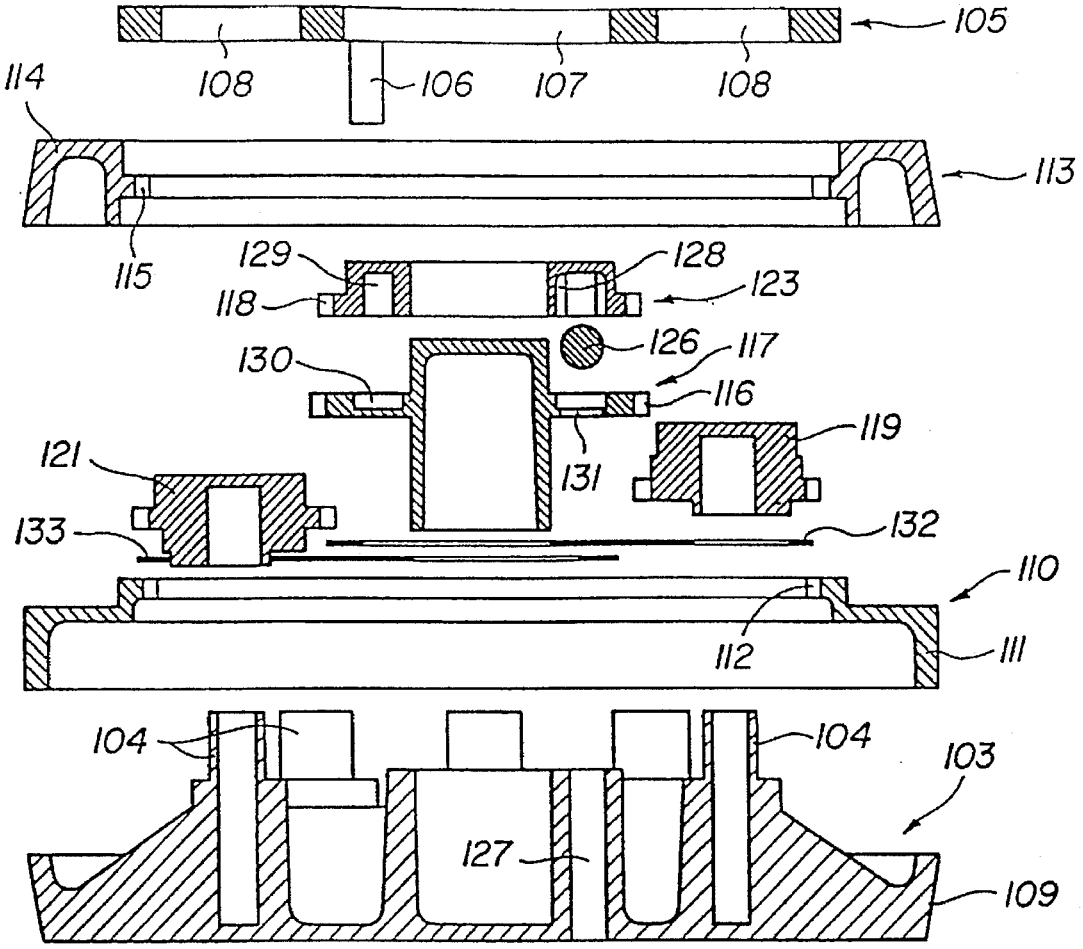
Figure 9:
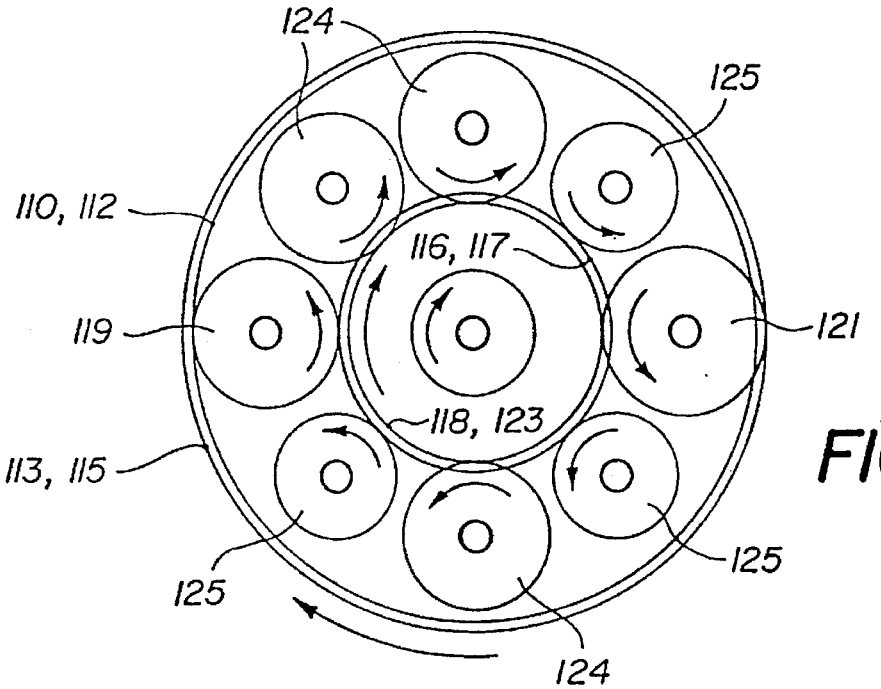
Figure 10:
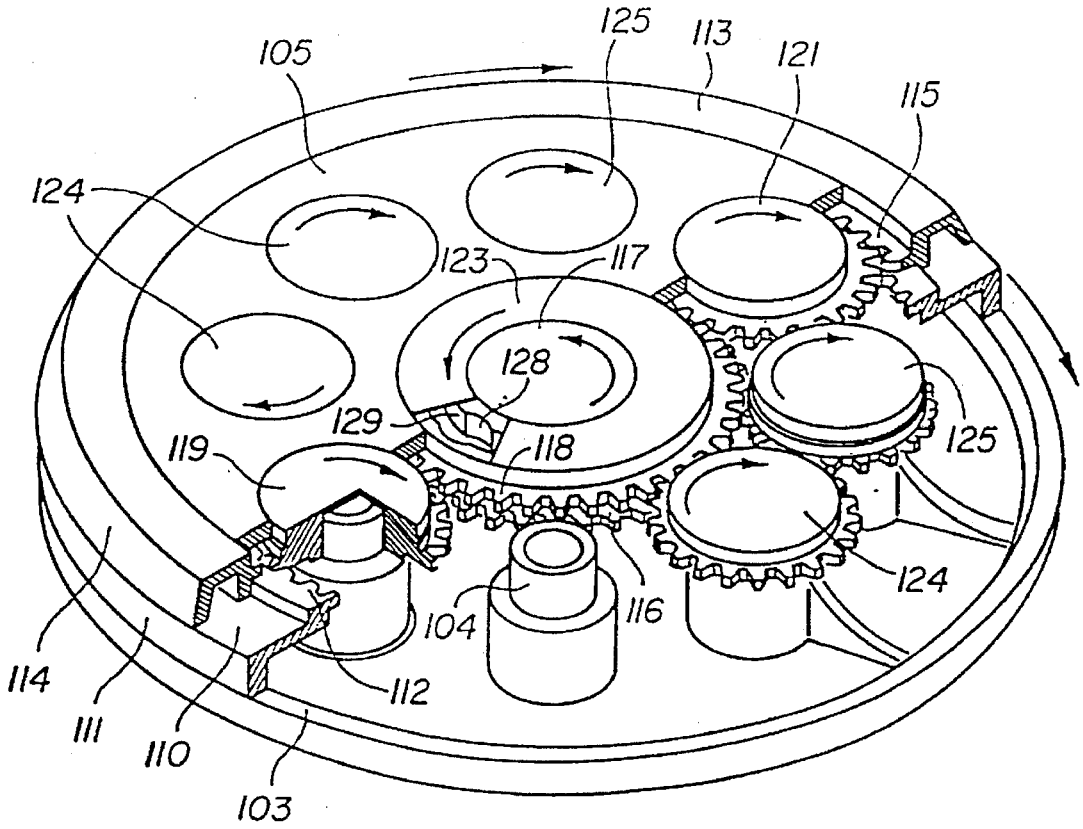
Figure 11:
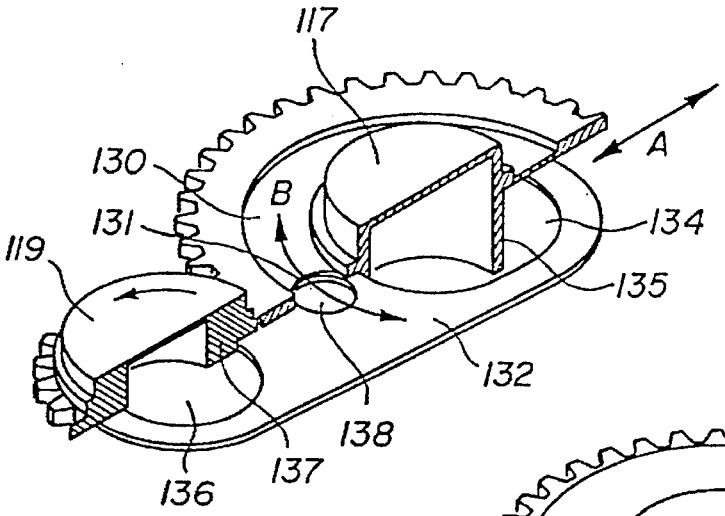
Figure 12:
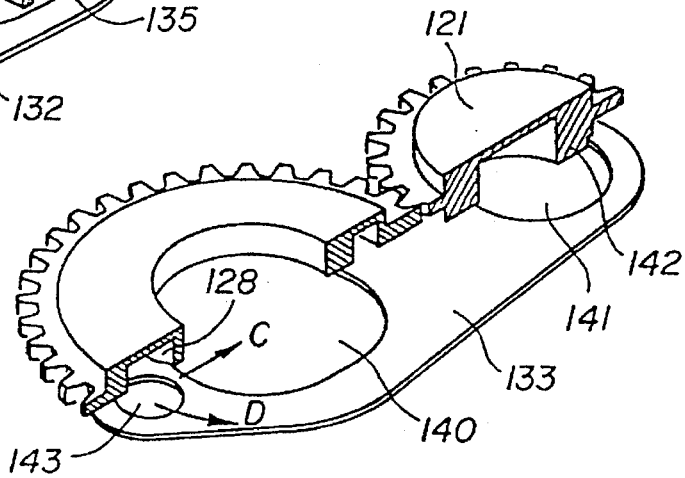
Figure 13:
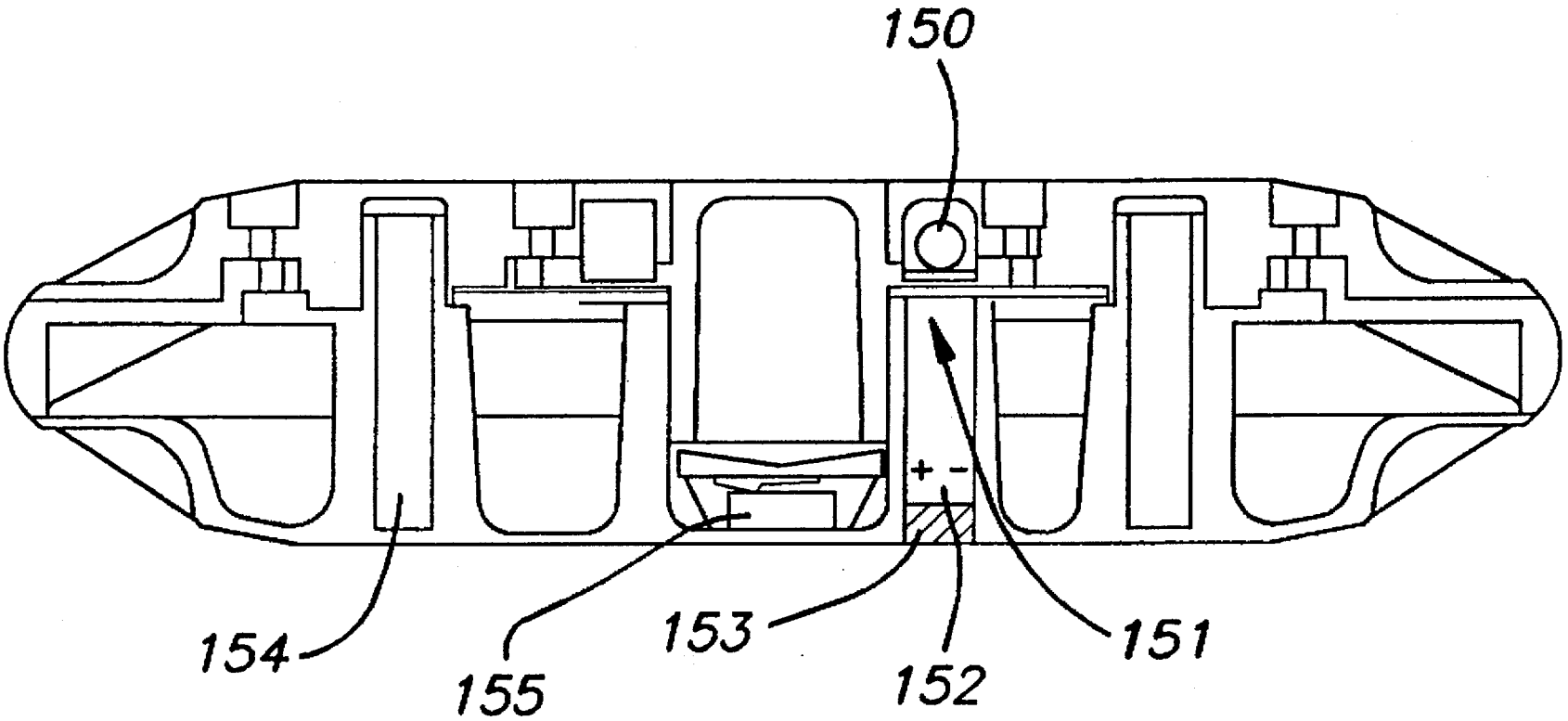

Other characteristics and advantages of the present invention will become apparent from the following description of various embodiments, with reference to the accompanying drawings, in which:

FIG. 1 is a partially cut-away perspective view of a preferred embodiment of a device according to the invention, FIG. 2 is an exploded view of the components of the device of FIG. 1, FIG. 3 is a plan view of the upper surface of a second embodiment of a device according to the invention, FIG. 4 is a schematic plan view of the pitch circles of the gearing of the device of FIG. 3, FIG. 5 is a fragmentary cross-sectional view on the line V—V of FIG. 4, FIG. 6 is a schematic plan view of a third embodiment of a device according to the invention, FIG. 7 is a fragmentary cross-sectional view on the line VII—VII of FIG. 6, FIG. 8 is an exploded vertical cross-sectional view of a fourth embodiment of a device according to the invention, FIG. 9 is a schematic plan view of the pitch circles of the gearing of the device at FIG. 8, FIG. 10 is a partially broken-away perspective view of the device of FIG. 8, FIGS. 11 and 12 are partially broken-away perspective views showing two closure members with a cam, shown in FIG. 10, and FIG. 13 is an axial cross-sectional view of a modified embodiment of a device according to the invention.

The device shown in FIGS. 1 and 2 is in the form of a substantially cylindrical assembly, whose upper surface 1 is circular and comprised by several visible surfaces which are movable relative to each other, these surfaces belonging to separate elements which can effect mutual movements of rotation and/or revolution, as will be described later. The interest of this device is to offer a multiplicity of possible combinations of the mutual positions of these surfaces, as will be better understood after the description of the construction of the device.

The base block 2 comprises three members secured to each other, namely, a base plate 3, a planet carrier 4 and an upper plate 5 having a first visible surface 6 in the upper surface of the device. The planet carrier 4 is secured directly in a flange 7 of the base plate 3, adjacent which it has a peripheral gripping surface 8 which is striated to permit manually gripping it without slipping. This surface 8 is cylindrical in the present case, but it could have any other suitable shape, for example prismatic. The cylindrical form permits easily driving the base block 2 to make it turn relative to the other elements of the device.

An intermediate ring 10 is mounted rotatably about the planet carrier 4 and has a peripheral gripping surface 11 analogous to the surface 8. This ring is provided with interior toothing 12 with eighty teeth. Above it, an upper ring 13 is mounted rotatably about the plate 5 and comprises a peripheral gripping surface 14, analogous to surfaces 8 and 11. It is provided with internal toothing 15 having eighty-two teeth, located above the toothing 12. In the plane of the upper surface 1 of the device, the ring 13 has a second visible surface 16 adjacent the surface 6.

A first planetary gearing is comprised by the toothing 12 of the ring 10, an idle planet pinion 17 provided with toothing 18 having forty-two teeth, and a set of four planets 19 (of which only a single one is shown in FIG. 2) having nineteen teeth, which are mounted on the planet carrier 4 by means of respective pins 20 secured to each planet 19. A second planetary gearing, disposed in a plane slightly above that of the first, comprises toothing 15 of the upper ring 13, a set of four planets 21 (of which only one is shown in FIG. 2) each having twenty-one teeth, mounted on the same planet carrier 4 by means of pins 22, and an idle planet pinion 23 with forty teeth which is mounted coaxially on the planet pinion 17. In the plane of the upper surface 1, the planet pinions 17 and 23 have respectively concentric visible surfaces 24 and 25 disposed in a central bore 26 of the plate 5. Thus, the four concentric visible surfaces 24, 25, 6 and 16 are next to each other two-by-two and rotate relative to each other.

Each pin 20, 22 has a central shaft provided with a longitudinal slot 30 so as to be able to be engaged by its elasticity in a central bore of the corresponding planet 19, 21 and blocked in rotation in this latter, for example by means of a wedge not shown. The lower end 31 of each pin 20, 22 is cylindrical and is engaged rotatably in a corresponding bore of the planet carrier 4. Moreover, each pin 20, 22 has a head 33 of disk shape, engaged in a corresponding circular hole of the upper plate 5. In the plane of the upper surface 1 of the device, the heads 33 have respective visible surfaces 34, 35 adjacent to the visible surface 6 of the plate 5. There are thus four surfaces 34 and four surfaces 35 turning at different speeds, respectively with the planets 19 and 21. The planets 19, 21 and the corresponding visible surfaces 34, 35 can be disposed in alternation or in groups of two as shown in FIG. 1, or else in any other manner compatible with the operation of the planetary gearings.

In the construction described above, the gearings provide kinematic connections with fixed ratios between the different movements of rotation and revolution of the rotatable elements and their visible surfaces, one rotation being the movement of each element about its own axis, and one revolution being the circular displacement of the axes of the planets about the central axis of the planetary gearing. These movements are controlled by individually turning one of the three gripping surfaces 8, 11 and 14 relative to the other two, or two of these surfaces relative to the third. More particularly, if the base block is considered as fixed, for example if it is positioned on a table, the visible surface 6 is fixed, as are also the axes of the planets. In this case, if the intermediate ring 10 is turned, its toothing 12 drives in rotation the planets 19 and the planetary pinions 17, and hence their visible surfaces 34 and 24, in the direction indicated by the arrows in FIG. 1. During this time, if the upper ring 13 does not turn relative to the base block 2, the planets 21 and the planetary pinion 23 of the second planetary gearing will not move.

Conversely, if only the upper ring 13 is turned relative to the base block, the toothing 15 of this ring drives the second planetary gearing, producing a rotation of the planets 21 and the planetary pinion 23, which is to say the visible surfaces 16, 35 and 25 turn relative to the adjacent stationary surfaces 6 and 24.

Finally, if the assembly of the two gripping surfaces 11 and 14 of the rings 10 and 13 is grasped and the base block is turned by its gripping surface 8, the single stationary visible surface will be the surface 16 of the ring 13. All the other visible surfaces will rotate at different speeds, and moreover the surfaces 34 and 35 connected to the planets will undergo revolution about the central axis 40.

The multiple angular movements described above, controlled manually with three degrees of freedom, permit a very large number of combinations of mutual positions of the various visible surfaces juxtaposed on the upper surface of the device. These respective positions can be located by means of different graphical elements printed or applied in another manner to the visible surfaces, for example circular scales representing numerical data, or successive fields representing discrete data such as the names of persons or countries, indices for juxtaposition with these scales or these fields, a design covering two or several adjacent visible surfaces or even all of the surface 1, such that it is decomposed by any movement from a starting position of the device and that the game consists in recomposing it, etc. In the example shown in FIG. 1, the angular location means are illustrated simply in the form of a radial line comprising successive segments 41 to 46 on the visible surfaces 24, 25, 6, 34 and 16, these segments being aligned in an initial position. In the illustrated position, it will be seen that the rotation imposed on the ring 10 has destroyed the alignment by causing the two segments 41 and 44 to turn in opposite directions and through different angles. Similarly, the rotation of the upper ring 13 will produce different angular displacements of the segments 42 and 46, as well as other locating elements (not shown) applied to the visible surfaces 35 of the other set of planets.

In this way, it will be seen that the device of FIGS. 1 and 2 permits establishing complicated relationships between the various locating elements applied to the upper surface 1, for amusement purposes. An interesting use consists in using such a device for displaying data relating to a sporting competition of the tournament type, comprising matches between two players or two teams, because the two drive rings 10 and 13 permit independently selecting the potential adversaries and, for each pair of adversaries, to display various statistical data or interesting results. For example, in a use devoted to the final round of the football World Cup, it is possible to display the places and dates of the games foreseen between two given teams, the results of the games that can be predicted from previous games, the ratings obtained by a team during these competitions, etc. The user thus has a sort of data bank with multiple entries.

In an embodiment of the invention shown in FIGS. 3 to 5, a base block 50 is comprised of two pieces, namely a generally circular base element 51, adapted to rest on a support surface and provided with a raised central portion 52, and an upper plate 53 fixed rigidly to the central portion 52 by means of a central rod (not shown). The plate 53 has a circular visible surface 54 in the upper flat surface of the device. The base element 51 also has projecting portions 55, 56 and 57 to support other elements of the device, as well as a peripheral gripping surface 58. An external ring 60 is mounted rotatably on the peripheral projecting portion 57 of the base member and has a peripheral gripping surface 61, a second visible surface 62 in the plane of the upper surface of the device, and interior toothing 63 with one hundred ten teeth. An internal ring 64 is rotatably mounted within the ring 60 and has a third visible surface 65, located between the visible surfaces 54 and 62, and internal toothing 66 with one hundred twenty teeth. Thus, each ring 60 and 64 can turn about the stationary plate 53, and hence about the central axis 69 of the device, when the gripping surfaces 58 and 61 are manually actuated.

The different rotatable elements of the device are interconnected by kinematic connections by gearing with fixed ratios. FIG. 4 shows various toothed wheels in the form of pitch circles, with the indication of the number z of teeth of each wheel. A first gear wheel 67 has twenty two teeth and is mounted rotatably on the projecting portion 56 and engages with the toothing 63 of the external ring 60. A second gear wheel 68 has twenty two teeth and is also mounted rotatably on the base member 51 and engages also with the wheel 67 and with the toothing 66 of the internal ring 64. As a result, there is a transmission ratio equal to −110/120 between the two rings 60 and 64.

A central toothed wheel 70 has thirty eight teeth and is mounted rotatably on the projecting portion 52 and engages with four toothed wheels 71 each having twenty-two teeth, identical to each other and mounted on the respective projecting portions 55 of base member 51. One of the four wheels 71, shown in FIG. 5, engages with the wheel 67, which permits driving from the external ring 60. In the plane of the upper surface of the device, the four wheels 61 have respective circular visible surfaces 72*a* to 72*d* in the corresponding holes of the plate 53. These four surfaces turn at the same speed and in the same direction.

FIG. 3 shows locator means which are printed or applied in another manner to the upper surface of the device, to permit establishing the relationships between the various relative angular positions of the visible surfaces mentioned above. In this example, it is an educational set of relative data with twenty-two regions of France and a principal city for each. The visible surface 62 of the external ring is divided into twenty-two equal fields 73, separated by radial lines and each bearing the name of one of the regions. Similarly, the periphery of the visible surface 54 is divided into twenty-two equal fields 74, separated by radial lines and each bearing the name of the principal city of the region. The rotatable visible surfaces 72*a* to 72*d* bear respective indices 75*a* to 75*d* and a text identifying the type of data which corresponds to this surface, namely: the name of the principal city, the population of the principal city, the population of the region and the area of the region. These twenty-two data for each index are printed on the stationary surface 54 in the form of circular lists 76*a* to 76*d* of names or numbers which are angularly equidistant. To find the correct data, the external ring 60 is turned relative to the base block 50 (or conversely) to place opposite each other the field 73 indicating the region and the field 74 indicating the principal city of this latter. When this registry is effected, the indices 75*a* to 75*d* indicate the corresponding correct data 76*a* to 76*d*. At the same time, the internal ring 74 has a predetermined position in which it is possible to read the distances between the principal city of this region and each of the other principal cities indicated in the fields 74. To this end, each field 74 is provided with a central index 77 facing which the corresponding distance is read from a circular list 78 printed on the visible surface 65.

An analogous system can be effected for other countries, having a different number of regions. For the nineteen regions of Italy or Spain, there can be provided nineteen teeth for the wheels 67 and 71, one hundred forty teeth for the toothing 63, one hundred twenty teeth for the toothing 66 and eight teeth for the gear wheel 68. In the case of the twenty-three cantons of Switzerland, there can be provided twenty-three teeth for the wheels 67 and 71, one hundred fifteen teeth for the toothing 63, one hundred twenty teeth for the toothing 66 and twenty-two teeth for the gear wheel 68. The number of teeth of the central wheel 70 can be freely chosen.

Generally speaking, a device of the type illustrated by FIGS. 3 to 5 is adapted to place in registry at least two respective elements of two series of data, which can as well be separate elements as continuous functions, to indicate different results as a function of the pair of selected data. If for example the fields 73 and 74 bear the names of teams in football or another sport, the list 78 can indicate the results of the matches between an indicated team by another field 73 and each of the indicated teams in the fields 74.

FIGS. 6 and 7 show a particularly simple embodiment of a device according to the invention. Within a substantially rectangular housing 80 having a flat upper surface 81, several toothed wheels 82 to 85 are mounted rotatably, about parallel axes, and have visible surfaces 86 to 89 in corresponding bores through the surface 81 of the housing. The first wheel 82 is provided with a drive wheel 90 which protrudes laterally from the housing to be manually actuated. This wheel drives with a first transmission ratio the second wheel 83, which drives the two wheels 84 and 85 with two other transmission ratios which can be different from each other. As in the preceding examples, this permits obtaining a large number of different combinations of angular positions of the visible surfaces 86 to 89 relative to each other and relative to the surface 81 of the housing. Locating elements such as designs, scales and indices, adapted to be placed in registry with each other, can be applied to the surfaces as in the preceding examples.

FIGS. 8 to 12 show still another embodiment of a device according to the invention. Actually, this is a modification of the device shown in FIGS. 1 and 2, having in particular analogous control means and visible upper surfaces that are analogous in principle. This is why the description of these surfaces and of the data that they can bear, will not be repeated.

A base block of the device is comprised by a base piece 103, serving as a planet carrier thanks to a crown 104 with eight projecting pivots, and an upper plate 105 provided with feet 106 securing it to the base piece 103. This plate comprises a circular central hole 107 and a crown of eight circular holes 108 for the planets. A peripheral gripping surface 109 is provided about the base piece 103.

An intermediate ring 110 is mounted rotatably on the base piece 103 and has a peripheral gripping surface 111. This ring is provided with internal toothing 112 having twenty-two teeth. Above it, an upper ring 113 is mounted rotatably about the plate 105 and comprises a peripheral gripping surface 114. It is provided with internal toothing 115 having eighty-four teeth.

As is seen particularly in FIGS. 9 and 10, a first planetary gearing is comprised by the toothing 112 and the ring. 110, an idle planetary pinion 117 provided with toothing 116 having forty teeth, and a satellite pinion 119 having twenty-one teeth engaging simultaneously the teeth 112 and 116. A second planetary gearing, disposed in a plane slightly above that of the first, comprises the toothing 115 of the upper ring 113, a idle planetary pinion 123 provided with toothing 118 having thirty-eight teeth, which is mounted coaxially on the planetary pinion 117, and a satellite pinion 121 having twenty-three teeth engaging the toothing 118 of the planetary pinion 123. As will be seen in FIG. 9, the other planets engage only one or the other of the planetary pinions 117 and 123. Three planets 124 having twenty-one teeth engage the planetary pinion 123, whilst three planets 125 having nineteen teeth engage the toothing 116 of the planetary pinion 117. As a result, a rotation of the intermediate ring 110 (toothing 112) relative to the base block causes the elements 119, 117 and 125 to turn, whilst a rotation of the upper ring 113 (toothing 115) relative to the base block causes the elements 121,123 and 124 to turn. As a result, the upper visible surfaces of said elements turn relative to each other in a manner analogous to the example of FIGS. 1 and 2, except that the angular distances are different because of the different numbers of teeth.

A small ball 126 (FIG. 8) is imprisoned within the device and the game consists in causing it to leave through a hole 127 of the base piece 123, thanks to a suitable positioning of the rotatable elements of the device. The ball 126 is imprisoned in a cylindrical recess 128 formed by an enlarged portion of an annular groove 129 in the lower surface of planetary pinion 123. This groove is closed downwardly by the planetary pinion 117, presenting opposite the groove 129 an annular groove 130 in which the ball 126 can roll. The bottom of the groove 130 comprises a circular hole 131 permitting the ball 126 to pass therethrough when it is located exactly above the recess 128. Thus, the planetary pinion 117 constitutes a first closure member between the recess 128 and the outlet hole 127. However, it is also provided with two other closure members above the hole 127, in the form of two flat cams 132 and 133 actuated respectively by planetary pinions 119 and 121 and shown in greater detail in FIGS. 11 and 12.

In FIG. 11, it will be seen that the flat cam 132 comprises an oblong hole 134 whose width corresponds to the external diameter of a lower cylindrical skirt 135 of the planetary pinion 117, such that the cam 132 is guided slidably radially on this skirt in the direction of the double arrow A. The other end of the cam 132 comprises a circular hole 136 receiving an eccentric circular protuberance 137 of the satellite pinion 119, whose rotation gives a connecting rod movement to the cam 132. In its central portion, the cam comprises a hole 138 for the passage of the ball 126. This hole moves not only radially according to the double arrow A, but also in a circumferential direction according to the double arrow B, which is to say that a single position of the satellite pinion 119 causes the hole 138 of the cam to coincide with the outlet hole 127.

The second cam plate 133 is actuated in an analogous manner, but by the satellite pinion 121. In FIG. 12, the planetary pinion 117 has been omitted to clarify the drawing, but the cam is also guided by the skirt 135 of this pinion, thanks to an oblong hole 140. One end of the cam 133 comprises a circular hole 141 surrounding an eccentric circular projection 142 on the pinion 121. The other end of the cam comprises a hole 143 for the passage of the ball 126, this hole being displaced radially according to the arrow C and tangentially according to the arrow D by the rotation of the satellite pinion 121. As a result, a single position of the satellite pinion 121 ensures coincidence between the hole 141 of the cam and the outlet hole 127.

As a result, the ball 126 can be freed only in a single position of the elements 117, 119, 121 and 123 relative to the base member 103, so as to have exact coincidence of the recess 128 of the ball with the holes 131, 138, 143 and 127. The ball can then fall by gravity through the outlet hole 127 and leave the device. According to a modification, it can be retained within the hole 127 by a transparent plug (not shown) permitting one to see for example the color of the ball.

With this device, the game therefore consists in finding the single position capable of freeing the ball, by suitable rotations of the rings 110 and 113 on the base member 103 so as to obtain the desired coincidences of the upper visible surfaces of the rotatable elements. These coincidences can be identified by graduated scales, indices, complementary designs, etc., as was described in connection with the preceding examples.

An original and attractive aspect of this embodiment is that the ball can constitute not only a signal that the game has been won when it is freed, but can moreover be of different colors indicating for example that the player is entitled to a more or less great prize in the lottery. This color is obviously not visible when the ball is located within its initial recess. The outlet hole 127 can be sinuous to prevent seeing the ball in its recess. For example, a green ball could indicate winning a first prize, a yellow ball the winning of a second prize and a red ball the winning of a consolation prize or a promotional article of a supplier whose mark constitutes a design to be reconstructed on the upper visible surface of the device.

Of course, in such a use of the lottery type, the device must be provided with a guarantee of integrity certifying that no manipulation has been carried out on the device since its manufacture. In the example illustrated by FIGS. 8 to 12, the guarantee can be given for example by means of a band glued on the peripheral surfaces 109, 111 and 114, this band having to be cut or tom to permit the rotation of the rings. There can also be provided other guarantees such as tongues whose rupture is necessary to permit the rotation of the rings.

With reference to FIG. 13, the device comprises principally a token in the form of a metallic ball 150 which, when the right combination is achieved, falls through a passage 151 (shown closed), in a recess 152 at the bottom of which is mounted a switch 153. When the ball closes the contact between two respectively positive and negative terminals of the switch 153, a battery 154 supplies an integrated circuit 155 arranged to control the emission either of a sonic signal or of a luminous signal or of the two signals simultaneously.

The described embodiments can be the subject of various modifications, in particular, in the case in which the device is provided with a sonic signal indicating that the player has found the right combination, it can be provided that the emitted sound corresponds to the illustrations of the device, for example the cry of the animal shown in the case of an educational game.

I claim:

1. Amusement device to match up graphic or alphanumeric data on at least one upper surface of the device, comprising:

a base plate (2, 50, 80, 103) having a first visible surface (6, 54, 81, 105) on said upper surface;

at least two rotatable elements (13, 17, 19, 21, 23, 60, 64, 71, 82–85, 113, 117, 119, 121,123–125) arranged to turn about parallel axes on the base block and having respectively a second and a third surface visible on said upper surface;

at least one manual drive means (10, 11, 13, 14, 60, 61, 90, 111, 114) to turn at least one of said rotatable elements relative to the base block;

rotation transmission means (12, 15, 18, 63, 66, 112, 115, 116, 118), forming kinematic connections with fixed ratios between the base block, the rotatable elements and the manual drive means;

angular locating means (41–46, 73–78), disposed on said visible surfaces of the base block and rotatable elements and representing data and results in the form of circular scales, indices and/or other graphic elements, these locator means being disposed so as to be adapted to be placed in mutual registry by rotation of the rotatable elements driven by said manual means.

2. Device according to claim 1, characterized in that the transmission means comprise gearing.

3. Device according to claim 1, characterized in that the transmission means comprise chains or toothed belts.

4. Device according to claim 1, characterized in that two of said rotatable elements (13, 17, 23, 60, 64, 113, 117, 123) are coaxial.

5. Device according to claim 4, characterized in that the first, the second and the third visible surface are adjacent two-by-two, one of them (25, 65) being located between the two others (6, 24; 54, 62).

6. Device according to claim 1, characterized in that said two rotatable elements (60, 64, 82–85) are coupled by a kinematic connection with fixed ratios, one to the other and to a common manual drive means (61, 90).

7. Device according to claim 1, characterized in that said two rotatable elements (17, 19; 21, 23; 119, 121) are coupled respectively to two manual drive means (10, 13; 110, 113), adapted to be actuated independently of each other.

8. Device according to claim 2, characterized in that the transmission means comprises at least one planetary gearing.

9. Device according to claim 8, characterized in that three coaxial elements of planetary gearing, namely two planet wheels (13, 23, 113, 123) and a planet carrier (4, 123), belong respectively to said rotatable elements and to said base block (2).

10. Device according to claim 8, characterized in that planets (19, 21) of the planetary gearing also constitute rotatable elements each having a visible surface (34, 35) provided with locating means (44).

11. Device according to claims 7, characterized in that the transmission means comprises two coaxial planetary gearings which have an element (4, 103) in common and which are each coupled to one of the two manual drive means (10, 13, 110, 113).

12. Device according to claim 11, characterized in that said manual drive means are external planet wheels (10, 13, 110, 113) of the planetary gearings and comprise gripping means (11, 14, 111, 114) on their periphery.

13. Device according to claim 11, characterized in that said common element is a planet carrier (4) which is a part of the base block (2).

14. Device according to claim 13, characterized in that the planet carrier (4) and two interior planet wheels (17, 23) of the planetary gearings have mutually concentric visible surfaces (6, 24, 25) on said upper surface (1).

15. Device according to claim 1, characterized in that it contains a hidden recess (128) for a token, particularly a ball (126), an opening (127) for an outlet or for visualization of the token, and movable closure members (112, 132, 133) driven by the rotatable elements and arranged to close a passage of the token between said recess and said opening, each closure member comprising a hole (131, 138, 143) for the passage of the token (126), said passage being freed by a single position of mutual coincidence of the recess, of the holes and of the opening, corresponding to a predetermined position of said visible surfaces.

16. Device according to claim 15, characterized in that said recess (128) is located in one (123) of the rotatable elements.

17. Device according to claim 15, characterized in that at least one of the closure members is comprised by one (117) of the rotatable elements.

18. Device according to one of claims 15, characterized in that at least one of the closure members is a flat cam (132, 133) driven in translation (A, C) and pivotally (B, D) by one (119, 121) of the rotatable elements.

19. Device according to claim 15, characterized in that said token (126) comprises a sign indicating a win, particularly a predetermined color.

20. Device according to claim 15, characterized in that it comprises means, which coact with said token, to trigger a sonic and/or visible signal at the moment of freeing this token.

21. Device according to claim 20, characterized in that said means comprise a switch (153) arranged to be actuated by said token, an energy source (154) and an integrated electronic circuit arranged to emit said sonic and/or visible signal.

* * * * *